US005176460A

United States Patent [19]

Garry

[11] Patent Number: 5,176,460

[45] Date of Patent: Jan. 5, 1993

[54] PEN CAP FOR A WRITING INSTRUMENT BARREL

[75] Inventor: Patrick J. Garry, Louisville, Ky.

[73] Assignee: Stry-Lenkoff Company, Louisville, Ky.

[21] Appl. No.: 712,464

[22] Filed: Jun. 10, 1991

[51] Int. Cl.[5] ..... B43K 5/00

[52] U.S. Cl. ..... 401/202; 401/213; 401/243

[58] Field of Search ..... 401/202, 213, 243

[56] References Cited

U.S. PATENT DOCUMENTS

| | | | |
|---|---|---|---|
| 4,969,766 | 11/1990 | Nagle et al. | 401/213 X |
| 5,000,604 | 3/1991 | Isoda | 401/202 |
| 5,051,015 | 9/1991 | Moeck | 401/202 |
| 5,066,156 | 11/1991 | Petrillo et al. | 401/202 X |

FOREIGN PATENT DOCUMENTS

| | | | |
|---|---|---|---|
| 394609 | 10/1990 | European Pat. Off. | 401/202 |
| 3817248 | 10/1989 | Fed. Rep. of Germany | 401/202 |
| 2218381 | 11/1989 | United Kingdom | 401/202 |
| 2224244 | 2/1990 | United Kingdom | 401/213 |

*Primary Examiner*—Danton D. DeMille

[57] ABSTRACT

A pen cap for a writing instrument barrel including a chamber defining inner housing adapted to snuggly receive a reduced nib carrying portion of the barrel and a spaced flow-through outer housing coextensive at the proximal end thereof with the inner housing to define a narrow passage therebetween with spaced radially extending rib members extending thereacross between the spaced inner and outer housing to strengthen the pen cap at the proximal end thereof.

12 Claims, 2 Drawing Sheets

PEN CAP FOR A WRITING INSTRUMENT BARREL

BACKGROUND OF THE INVENTION present invention relates to a pen cap for a writing instrument barrel and more particularly to a ventilated pen cap for a writing instrument barrel of the marking type.

Pen caps of various structures for writing instrument barrels are generally well known in the stationery art and, in fact, it more recently is known to provide a molded plastic pen cap for a writing instrument barrel of the marking type which includes an inner housing which defines a chamber open at one end for receiving the nib of a writing instrument barrel and a spaced flow-through open ended outer housing which receives the writing instrument barrel at the proximal end of the cap and defines a narrow passage with the inner housing at the distal end of the cap between the inner and outer housing with a thin spider with radially extending spaced spokes being provided adjacent the open, nib receiving end or proximal end of the inner housing. This known plastic cap further includes a sharp edged clip integral at the proximal end of the cap with an annular ring.

The present invention recognizes that even the more recent type of molded plastic type pen cap as above described has had its limitations in strength, durability, ventilation ability and protection of the marking nib to extend the shelf-life thereof. Recognizing the disadvantages of past pen caps including those of the more recent molded plastic ventilating type the present invention provides a molded plastic pen cap which provides ventilation when in both barrel assembled and disassembled relation, which provides increased cap body strength at the proximal end of the cap and which promotes enhanced ventilating air flow-through. Further, the present invention provides a cap structure which enhances nib assembly thereto and fluid medium shelf-life through narrowed, extending passages surrounding the nib protecting inner housing, the inner housing being located at the proximal end of the cap with the closing tapered end of the inner housing being located in a position comparatively removed from surrounding ambient conditions, at the same time, providing a venturi-like enhanced ventilating air flow along the narrow surrounding passages if needed. In addition, the unique and novel cap structure of the present invention not only provides a cap arrangement with increased proximal end strength, but also an arrangement which provides an extended clip integral therewith to satisfy the requirements of consumer small parts regulations. Moreover, the present invention provides a novel clip which is contoured to both avoid the undesirable sharp edges of past plastic clips and to avoid possible plastic defects which might otherwise occur during the molding process.

Various other features of the novel cap structure of the present invention will become obvious to one skilled in the art upon reading the disclosure set forth herein.

BRIEF SUMMARY OF THE INVENTION

More particularly the present invention provides in combination with an evaporative fluid medium carrying marking instrument barrel having a fluid medium transmitting marking nib disposed at the marking end thereof, an improved protective cap for the barrel and the nib comprising: an inner chamber defining first housing sized and configured to have an open proximal end to receive the marking nib and to snuggly engage the marking instrument barrel at the marking end thereof to surroundingly and nestingly accommodate the marking nib in the inner chamber, the snuggly engaging barrel and inner chamber defining housing sealing the inner chamber with the marking nib disposed therein remote from ambient; an outer flow-through chamber defining second housing having opposed open ends, the outer second housing having at least one of the open ends proximal to the open end of the first inner housing which is adapted to receive the marking nib, the outer housing being coextensive with the inner housing and sized to provide a narrow flow-through passage therebetween; and, spaced structural supports extending across the narrow flow-through passage with opposed ends fixed respectively to the first inner and the second outer housings, reinforcing the protective cap adjacent the marking nib accommodating proximal end thereof.

It is to be understood that various changes can be made by one skilled in the art in one or more of the several parts of the structure disclosed herein without departing from the scope or spirit of the present invention. For example, the contour of barrel and cap need not necessarily be cylindrical in shape nor does the contour of the inner housing necessarily have to be of the cylindrical shape as disclosed.

BRIEF DESCRIPTION OF THE DRAWINGS

Referring to the drawings which disclose one advantageous embodiment of the present invention.

DETAILED DESCRIPTION OF THE DRAWINGS

Figure 5:
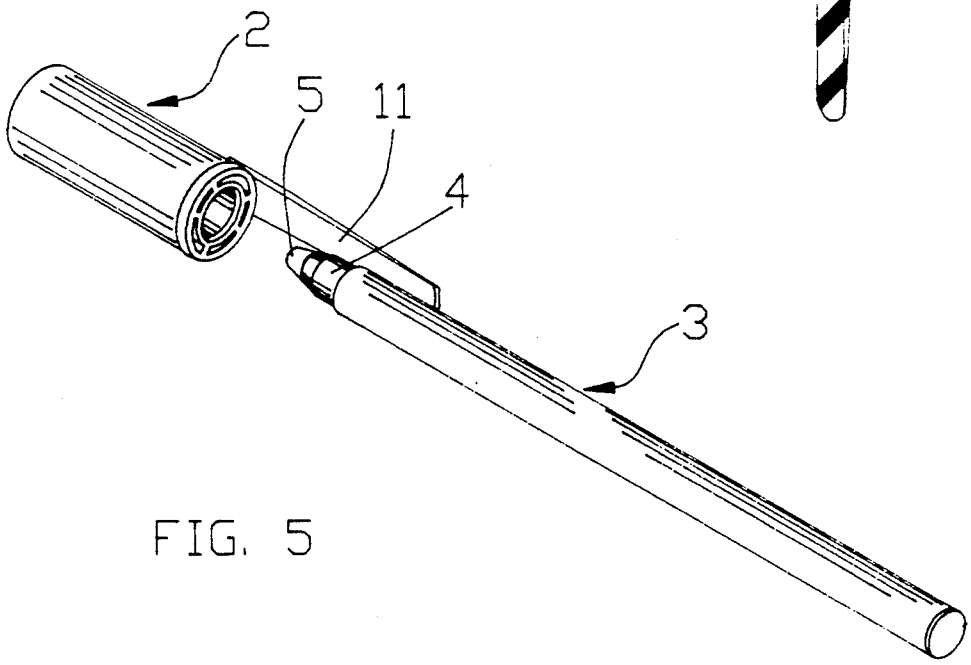
FIG. 5 is a reduced isometric exploded view of the pen cap of FIGS. 1–4 in association with the marking barrel and marking nib to which it can be assembled; and, FIG. 6 is an enlarged cross-sectional side view of the pen cap of FIGS. 1–5 taken in a plane through line 6—6 of FIG. 2.

Referring briefly to the exploded isometric view of FIG. 5, the inventive pen cap 2 of FIGS. 1–4 and 6 is disclosed in exploded combination with an evaporative fluid medium carrying marking instrument in the form of a barrel 3 having a reduced portion 4 at one end thereof with a fluid medium transmitting, porous, tapered marking nib 5 at the end of reduced portion 4. Marking nib 5 is capable of transmitting a marking fluid which is of a preselected composition so as to combine chemically or physically with a preselectively composed invisibly marked substance on a marking or writing surface, thus producing or revealing such substance visibly. It is to be understood that although marking or writing barrel 3 and the pen cap 2 to be assembled therewith are advantageously disclosed to be substantially of cylindrical shape with cap 2 having an outer diameter greater than the outer diameter of barrel 3 (as shown in FIG. 5 of the drawings) so that the inventive features of the present invention can be of effect whether the cap 2 is in assembled or cap-off disassembled relation to the barrel 3 other geometric configurations for barrel and pen cap could be effectively utilized in incorporating the several features of the present invention. It further is to be understood that although both pen cap 2 and barrel 3 can each be integrally mold formed from any one of a number of known suitable plastic materials of a preselected low porosity—such as a polypropylene—other materials can be utilized and that the several parts of pen cap 2 and barrel 3 need not each be of integral unitary formation.

Figure 6:
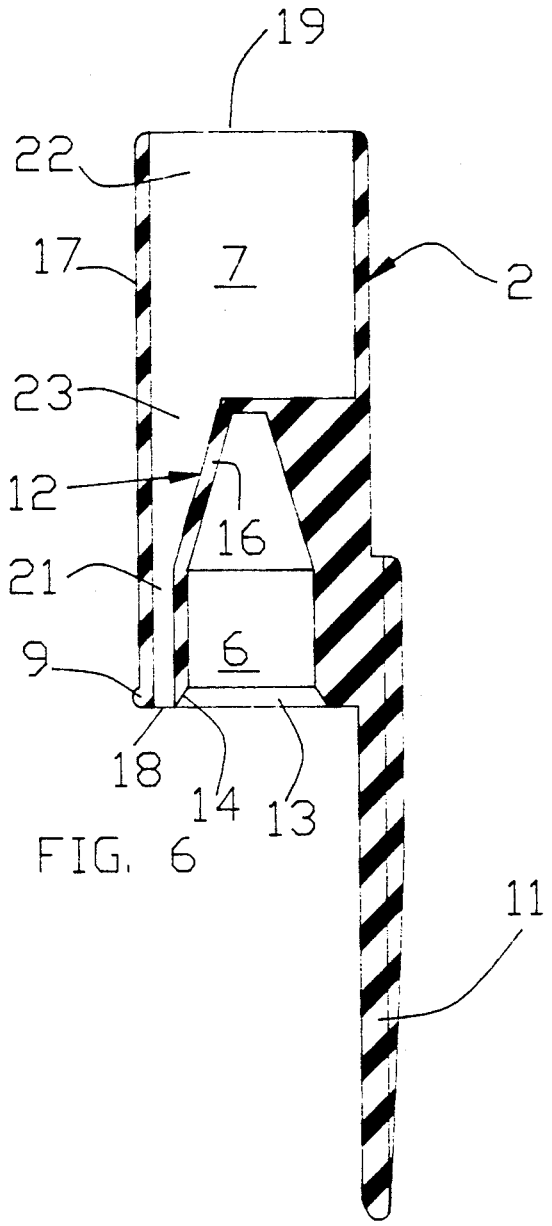

Referring to the novel pen cap 2 structure in FIGS. 1-4 and 6 of the drawings, and particularly to FIG. 6, pen cap 2, as disclosed, can be mold formed from a suitable plastic material, such as a low porosity polypropylene, to include an inner chamber 6, a spaced outer chamber 7, spaced structural supports 8 therebetween, an outer chamber reinforcing, assembly orienting ring 9 and a clip 11 longitudinally extending in cantilever fashion therefrom.

Again referring particularly to FIG. 6 of the drawings, the inner chamber 6 is defined by a substantially cylindrical housing 12 which is sized and configured to have an open proximal end 13 sized and configured to receive tapered marking nib 5 and to snuggly engage the reduced portion 4 of cylindrical barrel 3. It is to be noted that the proximal open end 13 of housing 12 is provided with a peripheral inwardly tapered configuration as at 14 to enhance the ready centering of tapered marking nib 5 to be disposed in chamber 6 and that the distal end of housing 12 is closed in tapered configuration as at 16 and is so sized to accommodate the tapered marking instrument nib 5 snuggly therein. It is to be understood that the plastic material forming housing 12 for inner chamber 6 is of a preselected thickness and porosity to provide minimal fluid evaporation and thus enhance the shelf-life of the fluid cooperative with dispensing nib 5.

The molded plastic outer chamber 7 is defined by a second flow-through spaced outer cylindrical housing 17 which has opposed proximal and distal open ends 18 and 19 respectively with the proximal open end 18 being adjacent to the inwardly tapered open end 13 of the first housing 12 which snuggly receives the tapered marking nib 5 and the reduced portion 4 of the barrel to which nib 5 is attached. Outer housing 17 is co-extensive with inner housing 12 from which it is spaced and is of greater length than inner housing 12 to define a narrow proximal flow-through passage 21 with inner housing 12 and a larger flow-through distal chamber 22 which is communicatively connected to narrow passage 21 by a venturi-like transition 23 brought about by the tapered distal end 16 of inner housing 12. In this regard, it is to be noted that the narrow flow-through passage 21 is divided into a plurality of narrow, radially extending sub-passages 21' (FIGS. 3 and 4) by virtue of rib-like spaced structural supports 8 which extend radially between inner housing 12 and outer housing 17 substantially along the entirety of the longitudinal axis of inner housing 12. Not only do these supports 8 serve to enhance the strength of pen cap 2 at the proximal end thereof where such strength is needed in the assembly of cap 2 with barrel 3 but, in addition, the narrow flow-through sub-passages 21' resulting therefrom probably serve to inhibit evaporation of fluid from inner chamber 6 with the closed end of such chamber 6 adjacent nib 5 of barrel 3 when assembled being remote from ambient.

Figure 1:
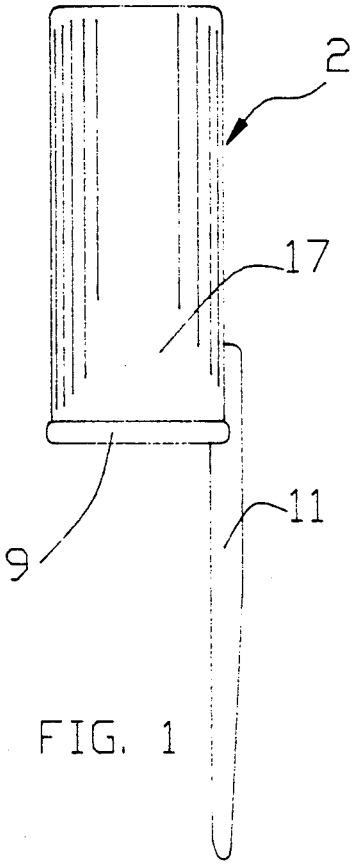
FIG. 1 is a side view of the inventive pen cap structure, disclosing the integral pen clip and annular ring at the proximal end of the pen cap.
Figure 2:
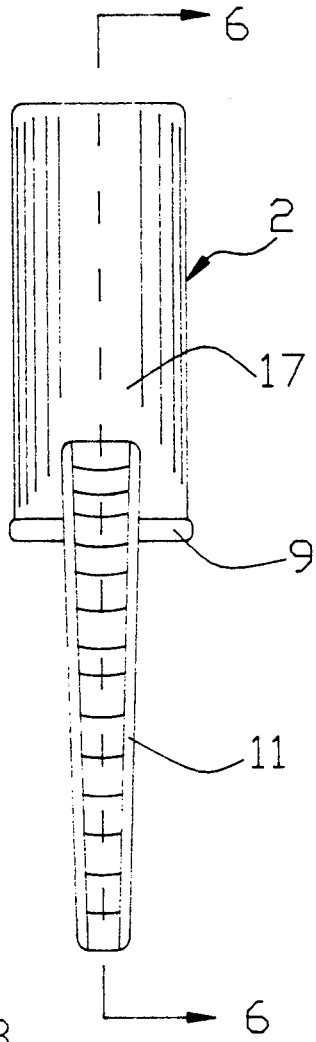
FIG. 2 is another side view of the pen cap structure of FIG. 1 taken at ninety (90) degrees from the view of FIG. 1, the curved lines bringing out the novel convex curvature of the face of the pen clip.
Figure 3:
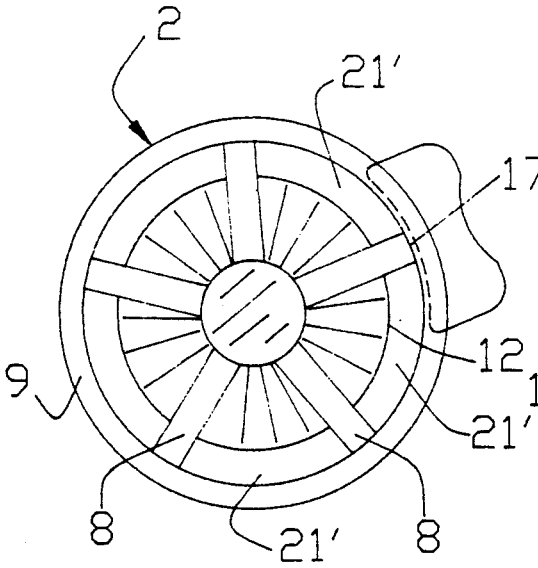
FIG. 3 is an enlarged end view of the distal end of the pen cap of FIGS. 1 and 2.
Figure 4:
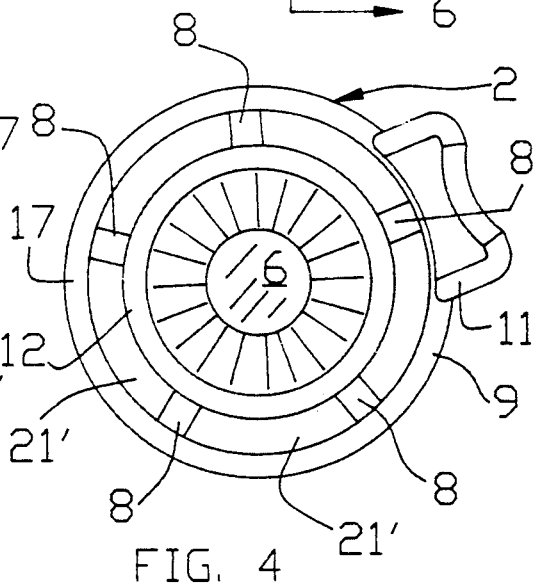
FIG. 4 is an enlarged end view of the proximal end of the pen cap of FIGS. 1 and 2.

As can be seen clearly in FIGS. 1 and 2 of the drawings, to further enhance the structural strength of pen cap 2 at the proximal end thereof, the annular reinforcing ring 9 is provided. Ring 9 is, in the embodiment disclosed, an integral part of pen cap 2, surrounding the outer peripheral proximal open end 18 of outer housing 17 and including clip 11 which extends in cantilever form therefrom without undesirable sharp edges. Clip 11 in addition to serving as a fastening device for the assembled pen cap 2 and writing instrument barrel 3 further is of a dimensional length which insures that the pen cap part 2 with integral clip 11 qualifies to be in excess of the minimum required federal code standards for small parts.

From the above it can be seen that a novel pen cap arrangement is provided for ready assembly with the marking nib carrying barrel portion of a pen, the pen cap having extra strength at its proximal end and at the same time providing a protective chamber for the marking nib to enhance nib shelf-life, the cap allowing for consistent ventilation whether in barrel assembled condition or in independent unassembled condition when it is more susceptible to a possible misuse and thus where ventilation takes on an added importance. In addition, the present invention provides a straightforward, efficient pen cap structure for both manufacture and assembly including a novel defect avoiding clip feature which qualifies it as acceptable under the requirements of small part code regulations.

The invention claimed is:

1. In combination with an evaporative fluid medium carrying marking instrument barrel having a fluid medium transmitting marking nib disposed at the marking end thereof, an improved protective pen cap for the barrel and the nib comprising:

an inner chamber defining first housing sized and configured to have an open proximal end to receive said marking nib and to snugly engage said marking instrument barrel at the marking end thereof to surroundingly and nestingly accommodate said marking nib in said inner chamber, said snugly engaging barrel and said inner chamber defining housing sealing said inner chamber with said marking nib disposed therein being remote from ambient;

an outer flow-through chamber defining second housing having opposed open ends, said outer second housing having one of said open ends proximal to the open end of said first inner housing which is adapted to receive said marking nib, said outer housing being coextensive with said inner housing and sized to provide in barrel assembled and cap-off disassembled relation a narrow flow-through passage therebetween in flow communication with said opposed open ends of said second housing; and, spaced structural supports extending radially across said narrow flow-through passage with opposed longitudinally extending side edges held in fast relation respectively to said first inner and said second outer housings to reinforce said protective cap adjacent said marking nib accommodating proximal end thereof.

2. The improved protective pen cap structure of claim 1, said open end of said inner chamber defining first housing having a tapered configuration to enhance the centering of said marking nib to be disposed therein.

3. The improved protective pen cap structure of claim 1, said radially extending spaced structural supports extending longitudinally substantially along the entirety of the longitudinal axis of said first inner housing.

4. The improved protective cap structure of claim 1, said outer second housing coextensive with said inner housing having a greater length than said inner housing to extend there beyond a define a larger distal chamber communicatively connected to said narrow flow-through passage defined by said coextensive first and second housings.

5. The improved protective pen cap structure of claim 4, said inner housing being geometrically configured to taper at the closed distal end thereof to connect said narrow flow-through passage with said large distal chamber through a venturi-like transition.

6. The improved protective pen cap structure of claim 1, said first and second inner and outer housings being of cylindrical shape sized to receive the marking nib of a cylindrical barrel in said first housing, said narrow flow-through passage being of annular shape and said spaced structural supports being radially extending rib members.

7. The improved protective pen cap structure of claim 1, said cap structure being of a preselected molded plastic material with minimum porosity to extend the shelf-life of the evaporative fluid medium.

8. The improved protective pen cap structure of claim 1, said second outer housing having one end of a longitudinally extending fastening clip fixed thereto so as to extend in cantilevering fashion to increase the overall length of said pen cap.

9. The improved protective pen cap structure of claim 1, said cap structure being of a preselected molded plastic material with minimum porosity to extend the shelf-life of the fluid cooperating with the marking nib, said second outer housing including a longitudinally extending clip integral therewith and extending in cantilevering fashion therefrom from a reinforcing ring surroundings the outer periphery of said outer housing adjacent the proximal open end thereof.

10. The improved protective pen cap structure of claim 9, said cantilevering plastic clip having a longitudinally extending concave face to better avoid plastic molding defects.

11. The improved protective pen cap structure of claim 1, said spaced structural supports being in the form of radially spaced rib-like members extending substantially along the entirety of the longitudinal axis of said first inner housing to divide said narrow passage between said first inner housing and said second outer housing into a plurality of narrow radial sub-passages surrounding said first housing.

12. In combination with an evaporative fluid medium carrying marking instrument in the form of a cylindrical barrel having a reduced portion at one end thereof with a fluid medium transmitting tapered marking nib at the end thereof capable of transmitting a marking fluid preselected to combine with an invisibly marked substance on a surface to produce such substance visibly, an improved protective pen cap structure for said barrel comprising:

a unitary, molded, polypropylene cap of minimum porosity including an inner chamber, a spaced outer chamber, spaced structural supports therebetween, an outer chamber reinforcing ring and a clip longitudinally extending therefrom;

said inner chamber being defined by a first cylindrical inner housing portion sized and configured to have an open proximal end to receive said marking nib and to snugly engage said reduced portion of said barrel and a closed distal end said open end of said inner chamber defining first housing having an inwardly peripherally tapered configuration to enhance the centering of said tapered marking nib to be disposed therein and said closed distal end portion of said first housing being of tapered configuration to accommodate said tapered marking instrument nib therein;

said outer chamber having an outer diameter greater than the outer diameter of said barrel and being defined by a second flow-through outer cylindrical housing having opposed open ends, said outer housing having one of said open ends proximal to said inwardly tapered open end of said first inner housing adapted to receive said tapered marking nib and said reduced portion of said cylindrical barrel, said outer second cylindrical housing being coextensive with said inner housing and having a greater length than said inner housing to ext end there beyond to define a narrow proximal flow-through passage with said inner housing and a larger flow-through distal chamber communicatively connected to said narrow flow-through passage by a venturi-like transition created by said tapered closed distal end of said first housing with said communicating passages being in flow-through communication with said opposed ends of said second housing in barrel and cap assembled or disassembled relation;

said spaced structural supports being in the form of spaced radial rib-like members extending longitudinally along the entirety of the longitudinal axis of said first inner housing to divide said narrow passage between said first inner housing and said second outer housing into a plurality of narrow radial sub-passages surrounding said first housing;

said outer chamber reinforcing ring and clip longitudinally extending therefrom including an annular ring integral with and surrounding the outer peripheral proximal end of said outer second cylindrical housing with said clip extending in cantilevered longitudinal fashion therefrom and having a contoured longitudinally extending concave face to better absorb plastic molding defects.

* * * * *